United States Patent [19]

Odenwälder et al.

[11] 4,210,714

[45] Jul. 1, 1980

[54] PHOTOGRAPHIC MATERIAL WITH IMPROVED PROPERTIES

[75] Inventors: Heinrich Odenwälder, Cologne; Anita von König, Krefeld; Franz Moll; Walter Pätzold, both of Leverkusen; Lothar Rosenhahn, Cologne; Friedhelm Sommer, Leverkusen, all in, Fed. Rep. of Germany

[73] Assignee: Agfa-Gevaert Aktiengesellschaft, Leverkusen, Fed. Rep. of Germany

[21] Appl. No.: 886,811

[22] Filed: Mar. 15, 1978

[30] Foreign Application Priority Data

Mar. 18, 1977 [DE] Fed. Rep. of Germany ..... 2711942

[51] Int. Cl.[2] ..... G03C 5/30; G03C 7/00

[52] U.S. Cl. ..... 430/372; 430/419; 430/445; 430/551; 430/611

[58] Field of Search ..... 96/95, 109, 59, 61 M, 96/66 R, 66.1–66.5

[56] References Cited

U.S. PATENT DOCUMENTS

| | | | |
|---|---|---|---|
| 2,327,773 | 8/1943 | Dickey et al. | 96/66 HD |
| 2,364,350 | 12/1944 | Dickey et al. | 96/66 HD |
| 3,137,578 | 6/1964 | Selms | 96/109 |
| 3,577,240 | 5/1971 | Nishio et al. | 96/95 |
| 3,591,609 | 7/1971 | Silverman | 96/95 |
| 3,808,005 | 4/1974 | Willems et al. | 96/109 |
| 3,945,829 | 3/1976 | Zorn et al. | 96/109 |

*Primary Examiner*—Mary F. Kelley

*Attorney, Agent, or Firm*—Connolly & Hutz

[57] ABSTRACT

Process for the preparation of silver images by image-wise exposure of a photographic material comprising at least one light-sensitive silver halide emulsion layer and treatment of the material with a developer composition, wherein the improvement comprises the development is carried out in the presence of 3-mercapto-5-(2-furyl)-1,2,4-triazole. The 3-mercapto-5-(2-furyl)-1,2,4-triazole decreases the fog during development, and when this is the first development in a black-and-white or color reversal process, increases the reversal silver or color density.

5 Claims, No Drawings

PHOTOGRAPHIC MATERIAL WITH IMPROVED PROPERTIES

This invention relates to a photographic material containing at least one silver halide emulsion layer, the stability of which has been improved by the addition of a heterocyclic compound.

As is well-known, light-sensitive silver halide emulsions, especially those which have been chemically sensitized, tend to form fogs, i.e. nuclei which are developable without exposure. Fogging occurs if the emulsions are stored too long, especially if they are stored at elevated temperatures and atmospheric moisture, or if they are developed too long or at too high temperatures, if certain additives are used and if the emulsions are too strongly ripened. Optimum ripening is necessary to achieve maximum sensitivity. The fog nuclei which are readily formed by this ripening are particularly disturbing in reversal materials. When fog nuclei are present, the silver halide in the unexposed areas is also reduced in the first developer. Too little silver halide is then available for the second development, so that the densities obtained are too low.

It is known to add so-called antifogging agents or stabilizers to the photographic silver halide emulsion to reduce the formation of fog. Compounds which act as stabilizers are, for example, the heterocyclic mercapto compounds such as those described in German Auslegeschrift No. 1,183,371 and German Offenlegungschriften Nos. 2,308,530 and 1,622,271 as well as inorganic and organic mercury compound.

The known stabilizers have the disadvantage that, when used at effective concentrations, they generally reduce the sensitivity of the stabilized emulsions, thereby impairing their performance. The gradation of the emulsions may also be deleteriously affected by the stabilizers.

Stabilizers must also meet a wide variety of requirements with regard to their interaction with other photographic additives and in view of the multiplicity of photographic reproduction processes and the photographic materials used for them, so that there is a demand for new stabilizers since the known stabilizers do not satisfy these requirements.

It is an object of the present invention to find stabilizers which suppress the fog produced by development and storage and which cause little or no loss in sensitivity at the concentrations required to produce sufficient stabilization. Another object of this invention is the preparation of photographic emulsions which are stabilized with these substances.

It has now been found that 3-mercapto-5-(2-furyl)-1,2,4-triazole advantageously suppresses the fogging of the photographic material in the developer, in particular in developers which contain silver complex formers, as well as the fogging produced in storage. The present invention relates to a light-sensitive photographic material having at least one silver halide emulsion layer which contains 3-mercapto-5-(2-furyl)-1,2,4-triazole as stabilizer.

The substance according to the invention may be prepared by the process described by A. L. Mudzhoian and V. E. Afrikian in Doklady Akad. Nauk Arm. S.S.R. (Proc. Acad. Sci. Armenian S.S.R.) 17 (1953) 167.

The usual silver halide emulsions are suitable for the present invention. The silver halide contained in them may be silver chloride, silver bromide or a mixture thereof, and may have a small silver iodide content of up to 10 mol %.

The usual colour developer substances may be used, for example the following:

N,N-Dimethyl-p-phenylenediamine;
4-amino-3-methyl-N-ethyl-N-methoxyethylaniline;
2-amino-5-diethylaminotoluene;
N-butyl-N-ω-sulphobutyl-p-phenylenediamine;
2-amino-5-(N-ethyl-N-β-methanesulphonamidoethylamino)-toluene;
N-ethyl-N-β-hydroxyethyl-p-phenylenediamine;
N,N-bis-(β-hydroxyethyl)-p-phenylenediamine and
2-amino-5-(N-ethyl-N-β-hydroxyethylamino)-toluene;

Other suitable colour developers have been described, for example, in J. Amer. Chem. Soc. 73, 3100 (1951).

The process according to the invention is applicable to the treatment of a light-sensitive photographic material which contains couplers. These compounds may be conventional colour couplers, which are generally incorporated directly in the silver halide layers. For example, the red sensitive layer may contain a non-diffusible colour coupler for production of the cyan partial colour image, generally a coupler based on phenol or α-naphthol. The green sensitive layer would contain at least one non-diffusible colour coupler for production of the magenta partial colour image, conventional colour couplers based on 5-pyrazolone or indazolone normally being used for this purpose. Lastly, the blue sensitive layer unit may contain at least one non-diffusible colour coupler for producing the yellow partial colour image, generally a colour coupler having an open chain ketomethylene group. Colour couplers of these kinds are known in large numbers and have been described in numerous Patent Specifications, for example in the publication entitled "Farbkuppler" by W. Pelz in "Mitteilungen aus den Forschungslaboratorien der Agfa, Leverkusen/München", Volume III (1961) and K. Venkataraman in "The Chemistry of Synthetic Dyes", Vol. 4, 341–387 Academic Press 1971.

The non-diffusible colour couplers used may be 2-equivalent couplers which contain a releasable substituent in the coupling position so that they only require two equivalents of silver halide to form the dye, in contrast to the usual 4-equivalent couplers. Suitable 2-equivalent couplers include, for example, the known DIR couplers, in which the releasable group is released as a diffusible development inhibitor after the reaction with colour developer oxidation products. So-called white couplers may also be used in order to improve the properties of the photographic material.

The non-diffusible colour couplers and colour producing compounds are added to the light-sensitive silver halide emulsions or other solutions by the usual known methods. Those among them which are water-soluble or alkali-soluble may be added to the emulsions in the form of aqueous solutions, optionally with the addition of water-miscible organic solvents such as ethanol, acetone or dimethylformamide. Those among the non-diffusible colour couplers and colour producing compounds which are insoluble in water or alkalies may be emulsified in known manner, for example by adding a solution of these compounds in a low boiling organic solvent straight to the silver halide emulsion or by first mixing it with an aqueous gelatine solution and then removing the organic solvent in the usual manner. The resulting emulsion of the compound in gelatine is then mixed with the silver halide emulsion. If desired, so-called coupler solvents or oil formers may also be added to assist emulsification of such hydrophobic compounds. These coupler solvents or oil formers are generally higher boiling organic compounds in which the non-diffusible colour couplers and development inhibitor releasing compounds which are required to be emulsified in the silver halide emulsions become occluded in the form of oily droplets. Information on this subject may be found, for example, in U.S. Pat. Nos. 2,322,027; 2,533,514; 3,689,271; 3,764,336 and 3,765,897.

The binder used for the photographic layers is preferably gelatine but this may be partly or completely replaced by other natural or synthetic binders. Suitable natural binders include alginic acid and its derivatives, its salts, esters or amides, cellulose derivatives such as carboxymethyl cellulose, alkyl cellulose such as hydroxyethyl cellulose, starch or its derivatives such as its ethers or esters, or carrageenates. Examples of suitable synthetic binders include polyvinyl alcohol, partially saponified polyvinyl acetate and polyvinyl pyrrolidone.

The emulsions may also be chemically sensitized, e.g. by the addition of sulphur compounds at the chemical ripening stage, for example allyl isothiocyanate, allyl thiourea and sodium thiosulphate. Reducing agents are also suitable chemical sensitizers, e.g. the tin compounds described in Belgian Patent Nos. 493,464 and 568,687 and polyamines such as diethylene triamine or aminomethyl sulphinic acid derivatives, e.g. according to Belgian Patent No. 547,323.

Noble metals such as gold, platinum, palladium, iridium, ruthenium and rhodium and compounds of these metals are also suitable chemical sensitizers. This method of chemical sensitization has been described in the article by R. Koslowsky in Z.wiss.Phot. 46, 65–72 (1951).

The emulsions may also be sensitized with polyalkylene oxide, derivatives, e.g. with a polyethylene oxide having a molecular weight of between 1000 and 20,000, or with condensation products of alkylene oxides and aliphatic alcohols, gylcols, cyclic dehydration products of hexitols, alkyl-substituted phenols, aliphatic carboxylic acids, aliphatic amines, aliphatic diamines and amides. The condensation products have a molecular weight of at least 700, preferably more than 1000. These sensitizers may, of course, be combined in order to produce special effects, as described in Belgian Patent No. 537,278 and in British Patent No. 727,982.

The emulsions may also be optically sensitized, e.g. with the usual polymethine dyes such as neutrocyanines, basic or acid carbocyanines, rhodacyanines, hemicyanines, styryl dyes and oxonoles. Sensitizers of this kind have been described in the work by F. M. Hamer, "The Cyanine Dyes and Related Compound", (1964).

The emulsions may contain other stabilizers in combination with those according to the invention, e.g. homopolar or salt-type compounds of mercury containing aromatic or heterocyclic rings, such as mercaptotriazoles, simple mercury salts, sulphonium mercury double salts and other mercury compounds. Azaindenes are also suitable stabilizers, particularly tetra and pentaazaindenes, especially those which are substituted with hydroxyl groups or amino groups. Compounds of this kind have been described in the article by Birr in Z.wiss.Phot. 47, 2–58 (1952). Other suitable stabilizers include heterocyclic mercapto compounds, e.g. phenylmercaptotetrazole, quaternary benzothiazole derivatives and benzotriazole.

The emulsions may be hardened in the usual manner, for example with formaldehyde or halogen-substituted aldehydes which carry a carboxyl group, such as mucobromic acid, diketones, methane sulphonic acid esters and dialdehydes.

The photographic layers may also be hardened with epoxide-type hardeners or hardeners of the heterocyclic ethylene imine or the acryloyl type. Examples of such hardeners have been described, e.g. in German Offenlegungsschrift No. 2,263,602 and in British Patent No. 1,266,655. The layers may also be hardened by the process according to German Offenlegungsschrift No. 2,218,009 to produce colour photographic materials which are suitable for high temperature processing.

The photographic layers or colour photographic multilayered materials may also be hardened with diazine, triazine or 1,2-dihydroquinoline hardeners, as described in British Patent Nos. 1,193,290; 1,251,091; 1,306,544 and 1,266,655, French Patent No. 7,102,716 and British Patent Specification No. 1,452,669. Examples of such hardeners include diazine derivatives containing alkyl sulphonyl or aryl sulphonyl groups, derivatives of hydrogenated diazine or triazines, e.g. 1,3,5-hexahydrotriazine, fluoro-substituted diazine derivatives such as fluoropyrimidine, esters of 2-substituted 1,2-dihydroquinoline- or 1,2-dihydroisoquinoline-N-carboxylic acids. Vinyl sulphonic acid hardeners, carbodiimide hardeners and carbamoyl hardeners are also suitable, e.g. those described in German Offenlegungsschriften Nos. 2,263,602; 2,225,230 and 1,808,685, French Patent No. 1,491,807. German Patent No. 872,153 and DDR Patent No. 7218. Other suitable hardeners have been described, for example, in British Patent No. 1,268,550.

The stabilizers are preferably added to the light-sensitive silver halide emulsion layer in the form of solutions after chemical ripening or to the finished casting solution. The solvents used are water, aqueous alkalis, lower aliphatic alcohols or mixtures thereof.

The stabilizers may, of course, also be added to other photographic layers or to the developer bath.

The concentration of the stabilizer in the layers or in the development bath may vary within wide limits. It depends on the effect desired, the nature of the reproduction process and the composition of the photographic material.

When the stabilizer is used in a photographic layer, particularly if it is used in the silver halide emulsion layer, quantities of from 1 mg to 1 g per mol of silver halide have been found to be sufficient. Concentrations of from 10 to 200 mg of stabilizer per mol of silver halide are preferred. When used in the development bath, the stabilizer is preferably added in the form of its alkali metal salts. In this form, its concentration is also not critical. Optimum concentrations can easily be determined by a few simple laboratory tests. When these were carried out, concentrations of from 5 to 100 mg per liter of processing bath were found to be sufficient. When the exposed photographic material is passed through development bath which contains the stabilizer, it absorbs a certain quantity of compound in its water permeable layers. The stabilizer diffuses into the emulsion layer and is present during development. A stabilizing effect is also obtained in this way.

The advantageous effect of 3-mercapto-5-(2-furyl)-1,2,4-triazole is all the more surprising because there are many very similar compounds which do not reduce fogging, especially the fogging in the first developer, at least not without deleterious side effects on the sensitivity and gradation. The stabilizer used according to the invention reduces the sensitivity of the photographic silver halide emulsions to a much smaller extent than the other heterocyclic mercapto compounds known for this purpose. Even the sensitivity of the most highly sensitive silver halide emulsions is not substantially affected by the present stabilizer.

One particularly advantageous effect of the stabilizer used according to the invention is found in silver halide emulsions which contain colour couplers. The presence of colour couplers often greatly reduces the effect of other, known stabilizers so that, in the presence of silver halide emulsions which contain colour couplers, it is particularly difficult to achieve sufficient stability in storage and sufficient freedom from fog if development is prolonged or elevated development temperatures are employed. The stabilizer used according to the invention, on the other hand, has an excellent stabilizing effect in the event of prolonged storage or development at elevated temperatures even in the case of silver halide emulsions which contain colour couplers.

The advantages of using the stabilizer according to the invention will be clear from the following examples but the invention is not restricted to the embodiments described in these examples.

EXAMPLE 1

A highly sensitive silver iodobromide emulsion containing 5 mol % of iodide, a ratio of gelatine to silver of 1.2 and 85 g of silver nitrate per kg of emulsion was ripened to optimum sensitivity with sulphur compounds and gold compounds.

The mixture used for preparing the emulsion was divided into several portions and the following substances were added in the quantities given per kg of emulsion:

| | |
|---|---|
| 4-hydroxy-6-methyl-1,3,3a,7-tetraazaindene 1%, aqueous alkaline solution | 200 mg |
| Saponin 10%, dissolved in water | 600 mg |
| formalin solution 10%, dissolved in water | 10 ml |

In addition, the compound according to the invention (1) or the following comparison substances were added:

(1) 3-mercapto-5-(2-furyl)-1,2,4-triazole

A—1-(p-sulphonic acid-phenylamino)-2-methyl-5-mercapto-1,3,4-triazole

B—4-methyl-4-thiazoline-2-thione

C—3-mercapto-5-acetylamino-1-phenyl-1,2,4-triazole

D—3-mercapto-1,2,4-triazole

E—3-mercapto-5-amino-1,2,4-triazole

F—3-mercapto-5-(2-pyridyl)-1,2,4-triazole.

Comparison substances A to F were used in equimolar quantities, based on 40 mg of compound 1.

The emulsions were then cast on a cellulose acetate substrate and dried at an application of 6.0 to 6.2 g, calculated as silver nitrate, per $m^2$.

The samples were then exposed in a sensitometer behind a gray wedge and developed for 16 minutes at 20° C. in a developer I of the following composition:

Developer I

| | |
|---|---|
| Sodium sulphite sicc. | 50 g |
| Borax | 15 g |
| Hydroquinone | 6 g |
| 1-phenyl-3-pyrazolidone | 0.5 g |
| Potassium bromide | 2 g |
| made up to 1 liter with water. | |

This is followed by a short-stop bath consisting of 10 g of sodium acetate sicc. and 20 g of 96% glacial acetic acid in 1 liter of water. The samples are then fixed with 15% ammonium thiosulphate and 1% sodium sulphite solution and washed. The results of the sensitometric tests are shown in Table 1. It is found that compound 1 which is to be used according to the invention suppresses the sensitivity only at elevated concentrations while low concentrations have little or no effect of reducing the sensitivity but have a marked effect on the fog.

The advantage of using substance 1 according to the invention becomes quite clear when one considers the response of the photographic material to development at an elevated temperature in a developer containing a silver complex former. To test this, an unexposed sample is developed for 3 minutes in a developer II at 38° C.

Developer II

| | |
|---|---|
| 1-phenyl-3-pyrazolidone | 0.3 g |
| hydroquinone | 6.0 g |
| soda sicc. | 35.0 g |
| sodium sulphite sicc. | 50.0 g |
| potassium thiocyanate sicc. | 2.5 g |
| potassium bromide | 2.0 g |
| ethylenediamine-N,N,N',N'-tetracetic acid, $Na_4$salt | 2.0 g |

made up with water to 1 liter and adjusted to pH 10.0±0.1.

The subsequent stages of processing are carried out as indicated above. The "percentage fogging" in Table 1 is a measure of the degree of fogging obtained. It is calculated from the quotient of developed silver, as silver nitrate divided by the silver, as silver nitrate, before processing, multiplied by 100.

Table 1 shows that although the comparison substances A to F reduce the fog which is formed when Developer I is used, they either suppress the sensitivity or, in the case of Developer II which contains a silver halide solvent, they have little or no effect in reducing the fog and are therefore distinctly inferior to substance I used according to the invention as antifogging agent for reversal materials.

Table 1

| Sample | Compound number | mg/kg | Gradation | Developer I Sensitivity | Fog | Developer II percentage fogging |
|---|---|---|---|---|---|---|
| 1 | — | — | 0.56 | Typ | 0.14 | 30 |
| 2 | 1 | 10 | 0.49 | −0.2 | 0.10 | 18 |
| 3 | 1 | 20 | 0.47 | −1.0 | 0.10 | 15 |
| 4 | 1 | 40 | 0.48 | −1.5 | 0.10 | 16 |
| 5 | A | 73 | 0.49 | −0.5 | 0.08 | 29 |
| 6 | B | 31 | 0.39 | −3.0 | 0.07 | 27 |
| 7 | C | 56 | 0.49 | ±0 | 0.10 | 30 |
| 8 | D | 24 | 0.45 | −2.0 | 0.10 | 27 |
| 9 | E | 28 | 0.38 | −6.5 | 0.11 | 10 |
| 10 | F | 43 | 0.49 | ±0 | 0.12 | 31 |

EXAMPLE 2

500 ml of water, 300 ml of a 10% gelatine solution, 60 ml of a 1% aqueous alkaline solution of 4-hydroxy-6-methyl-1,3,3a,7-tetraazaindene and 300 ml of a 5% aqueous-alkaline solution of magenta couplers represented by the following general formula were added to 1 kg of an orthochromatically sensitized silver iodobromide emulsion which contained 0.29 mol of silver salt, consisting of silver bromide containing 3 mol % of silver iodide:

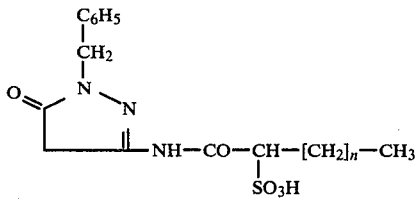

n = 17–19

The pH of the emulsion was then adjusted to 5.8. 6.5 g of saponin, dissolved in water, and 2.7 g of triacryloformal in methanolic solution were also added. The resulting emulsion was divided into 6 equal parts and compound 1 according to the invention and the comparison compounds were added to the individual samples in the quantities indicated in Table 2.

The samples of emulsion were cast on corona-irradiated polyethylene coated paper to produce layers containing 0.5 g of silver per $m^2$. A 2% gelatine solution was applied in each case to the emulsion layer in a thickness corresponding to 2 g of gelatine per $m^2$.

After drying, the materials were exposed behind a gray step wedge (wedge factor $\sqrt[3]{2}$) and developed in Developer III for 5 minutes at 25° C. Subsequent processing consisted of the following stages:

| | |
|---|---|
| Short-stop bath | 1 minute |
| washing | 3.5 minutes |
| diffuse second exposure | 20 seconds |
| colour development(Developer IV) | 6 minutes |
| washing | 2 minutes |
| bleach-fixing | 10 minutes |
| washing | 3 minutes |
| final bath | 1 minute |

Baths of the following composition were used:

Developer III

| | |
|---|---|
| hydroquinone | 6 g |
| 1-phenyl-3-pyrazolidone | 0.5 g |
| trisodium salt of nitrilotri-acetic acid | 5 g |
| sodium sulphite sicc. | 30 g |
| potassium bromide | 2.5 g |
| sodium carbonate sicc. | 25 g |
| sodium bicarbonate sicc. | 15 g |
| sodium sulphate sicc. | 10 g |
| benzotriazole | 0.02 g |
| potassium thiocyanate sicc. | 1.5 g |

made up with water to 1 liter and adjusted to pH 9.7±0.1.

Short-stop bath

| | |
|---|---|
| Acetic acid | 2% |

Developer IV

| | |
|---|---|
| hydroxylamine sulphate | 3 g |
| N-butyl-N-ω-sulfobutyl-p-phenylene diamine | 4.3 g |
| hydroquinone | 0.01 g |
| trisodium salt of nitrile-triacetic acid | 5 g |
| sodium sulphite sicc. | 3 g |
| potassium bromide | 1 g |
| potassium carbonate sicc | 70 g |
| sodium sulphate sicc. | 90 g |
| made up with water to 1 liter. | |

Bleach fixing bath

| | |
|---|---|
| tetrasodium salt of ethylene diamine-N,N,N',N'-tetracetic acid | 10 g |
| sodium sulphite sicc. | 2 g |
| sodium-ion-(III)- salt of ethylenediamino tetracetic acid | 40 g |
| disodium hydrogen phosphate sicc. | 13 g |
| ammonium thiosulphate | 100 g |

made up with water to 1 liter and adjusted to pH 7.5-7.7.

Final bath

| | |
|---|---|
| magnesium acetate (. $4H_2O$) | 5 g |
| formalin 30% | 5 ml |

made up with water to 1 liter.

The sensitometric assessment of the resulting samples is shown in Table 2. The sensitivity is determined at density 1.0.

It is found that the silver halide emulsions which contain colour couplers, compound 1 used according to the invention provides far better results than the comparison substances both in the tests on fresh material and in the tests after storage in the heating cupboard.

Similar results were obtained when the following yellow and cyan couplers were used instead of the magenta coupler.

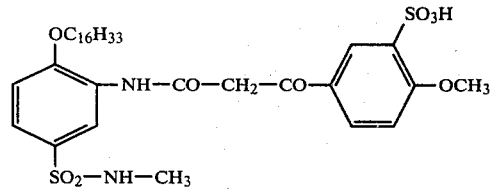

Yellow coupler

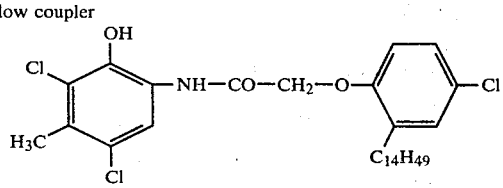

-continued

Cyan coupler

Table 2

| | | | Fresh Test | | | | | Test after 3 days storage in heating cupboard | | | | |
|---|---|---|---|---|---|---|---|---|---|---|---|---|
| Sample | Compound | mg/kg | Sensitivity | Γ | $D_{max}$ | Fog | % Fogging in Developer III | Sensitivity | | $D_{max}$ | Fog | % Fogging in Developer III |
| 1 | control sample | | — | — | 0.85 | 0.11 | 30 | — | — | 1.16 | 0.10 | 38 |
| 2 | 1 | 12.5 | 18.2 | 1.08 | 1.59 | 0.11 | 25 | 19.3 | 1.16 | 1.57 | 0.11 | 28 |
| 3 | 1 | 25 | 16.8 | 1.01 | 1.63 | 0.10 | 23 | 17.6 | 1.08 | 1.66 | 0.10 | 26 |
| 4 | 1 | 37.5 | 16.4 | 0.92 | 1.71 | 0.11 | 20 | 17.2 | 1.02 | 1.75 | 0.11 | 24 |
| 5 | B | 19.6 | 21 | 0.65 | 1.33 | 0.11 | 27 | 22.3 | 0.74 | 1.22 | 0.10 | 33 |
| 6 | C | 35.1 | 22.1 | 0.66 | 1.48 | 0.13 | 29 | 24.2 | 0.59 | 1.26 | 0.13 | 34 |

EXAMPLE 3

Colour photographic materials for reversal processing were prepared by applying the following layers in succession to a substrate of cellulose triacetate which had been coated with an adhesive layer:

(I) Control sample without 3-mercapto-5-(2-furyl)-1,2,4-triazole

1. A red-sensitized silver halide emulsion containing, per kg, 70 g of gelatine, 60 g of silver of which 96% was in the form of the bromide and 4% in the form of the iodide, and 55 g of the cyan coupler of the following formula

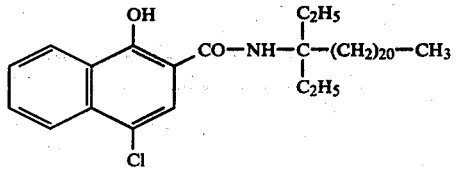

The silver application was 1.0 g per m², calculated as silver nitrate.

2. A 2% aqueous gelatine solution containing, per kg, 4 g of the polymeric white coupler of the following formula described in German Offenlegungsschrift No. 2,304,319:

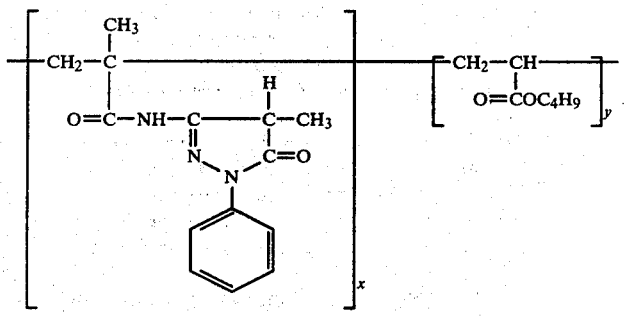

3. A green-sensitized silver halide emulsion containing, per kg, 70 g of gelatine, 60 g of silver 96% of which was in the form of the bromide and 4% in the form of the iodide, and 60 g of the magenta coupler represented by the following formula:

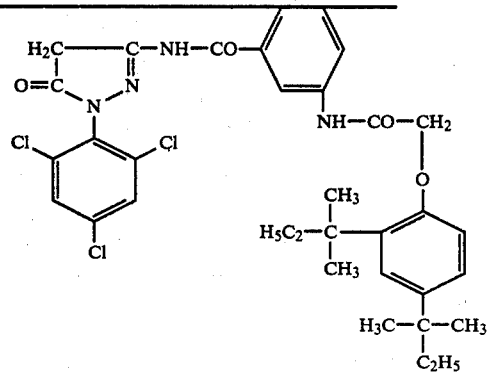

The silver application was 0.9 g per m², calculated as silver nitrate.

4. A silver dispersion containing 1.8 g of silver calculated as silver nitrate and 12 g of gelatine per liter. The colour density of the yellow filter layer determined behind a blue filter was 0.6; the silver application was 0.2 g/m², calculated as silver nitrate.

5. An unsensitized silver halide emulsion containing, per kg, 70 g of gelatine, 60 g of silver, 95% of which was in the form of the bromide and 5% in the form of the iodide, and 140 g of the following yellow coupler:

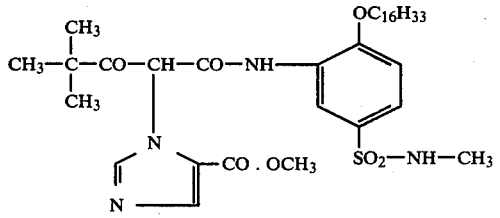

The silver application was 1.5 g per m², calculated as silver nitrate.

6. A 1% gelatine solution applied to form a layer weighing 60 g per $m^2$ when wet.
7. A 1% aqueous solution of the hardener represented by the following formula applied to form a layer weighing 60 g per $m^2$ when wet:

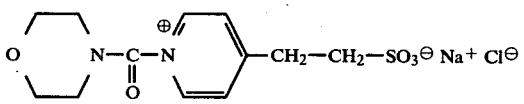

(II) Samples containing 3-mercapto-5-(2-furyl)-1,2,4,-triazole.

The sample was prepared as described for sample I but 60 mg per kg of 3-mercapto-5-(2-furyl)-1,2,4,-triazole were added to the yellow layer (layer 5).

(III) Comparison sample containing comparison compound F (3-mercapto-5-(2-pyridyl)-1,3,4-triazole)

Sample III was prepared in the same way as sample II except that comparison substance F at a concentration of 60 mg per kg of yellow layer were used instead of 3-mercapto-5-(2-furyl)-1,2,4-triazole.

Each of the samples I to III was exposed behind a gray graduated wedge and then subjected to the following reversal processing at 30° C.:

| | |
|---|---|
| Black-and-white development (developer V) | 6 min |
| short-stop bath | 2 min |
| washing | 2 min |
| diffuse second exposure | |
| colour development (developer VI) | 6 min |
| bleaching | 3 min |
| washing | 2 min |
| fixing | 3 min |
| washing | 2 min |

Baths having the following compositions were used:

Developer V

| | |
|---|---|
| Sodium hexametaphosphate | 2 g |
| sodium carbonate sicc. | 35 g |
| sodium sulphite sicc. | 50 g |
| 1-phenyl-3-pyrazolidone | 0.3 g |
| hydroquinone | 6.0 g |
| potassium thiocyanate sicc. | 2.0 g |
| potassium bromide | 1.5 g |
| potassium iodide | 10 mg |

made up with water to 1000 ml and adjusted to pH 10.0.

Short-stop bath

| | |
|---|---|
| Sodium acetate sicc. | 10 g |
| glacial acetic acid (96%) | 30 ml |

made up with water to 1000 ml and adjusted to pH 4.1.

Developer VI

| | |
|---|---|
| Trisodium salt of nitrilotriacetic acid | 2 g |
| trisodium phosphate sicc. | 20 g |
| sodium sulphite sicc. | 5 g |
| 1-(N-ethyl-N-hydroxyethyl)-3-methyl-p-phenylene diamine sulphate | 6 g |

made up with water to 1000 ml and adjusted to pH 12.0.

Bleaching bath

| | |
|---|---|
| Iron hexacyanoferrate (III) | 70 g |
| potassium bromide | 20 g |
| disodium hydrogen phosphate sicc | 15 g |

made up with water to 1000 ml and adjusted to pH 5 with acetic acid.

Fixing bath

| | |
|---|---|
| sodium thiosulphate (crystalline) | 180 g |
| potassium metabisulphite | 18 g |

made up with water to 1000 ml and adjusted to pH 5.0.

Sensitometric assessment shows that the photographic material which contains 3-mercapto-5-(2-furyl)-1,2,4-triazole (sample II) has substantially higher maximum densities than the control sample and the comparison sample.

| Sample | Compound | mg/kg yellow layer | $D_{max}$ |
|---|---|---|---|
| 1 | control sample | — | 2.4 |
| 2 | 1 | 60 | 2.9 |
| 3 | comparison substance F | 60 | 2.5 |

We claim:

1. A process of producing photographic images from photographic silver halide material containing at least one light-sensitive silver halide emulsion layer by imagewise exposure and photographic processing including developing exposed photographic material with a developer composition, wherein the improvement is, the processing of the exposed photographic material carries out development of the exposed material in the presence of a stabilizing amount of 3-mercapto-5 (2-furyl)-1,2,4-triazole.

2. Process according to claim 1 wherein the development is made in the presence of color couplers.

3. Process according to claim 1 wherein the photographic material is developed in the presence of said stabilizing amount in a developer which contains silver complex formers.

4. Photographic recording material comprising a light sensitive photographic material having at least one silver halide emulsion layer wherein the improvement comprises the material contains 3-mercapto-5-(2-furyl)-1,2,4-triazole in an effective amount to stabilize the silver halide emulsion during development.

5. A photographic recording material according to claim 1 wherein the material contains color couplers.

* * * * *